US005943071A

United States Patent [19]

Premnath

[11] Patent Number: 5,943,071

[45] Date of Patent: Aug. 24, 1999

[54] WIPER BLADE CLEANING SYSTEM FOR NOZZLE FACES OF A COLOR PRINTHEAD

[75] Inventor: Karai P. Premnath, Rochester, N.Y.

[73] Assignee: Xerox Corporation, Stamford, Conn.

[21] Appl. No.: 08/568,727

[22] Filed: Dec. 7, 1995

[51] Int. Cl.[6] ..... B41J 2/165

[52] U.S. Cl. ..... 347/33

[58] Field of Search ..... 347/33, 22, 43, 347/40

[56] References Cited

U.S. PATENT DOCUMENTS

| | | | |
|---|---|---|---|
| Re. 32,572 | 1/1988 | Hawkins et al. | 216/27 |
| 4,571,599 | 2/1986 | Rezanka | 347/87 |
| 4,746,938 | 5/1988 | Yamamori et al. | 347/28 |
| 4,849,774 | 7/1989 | Endo | 347/56 |
| 4,853,717 | 8/1989 | Harmon et al. | 347/24 |
| 4,855,764 | 8/1989 | Humbs et al. | 347/31 |
| 5,151,715 | 9/1992 | Ward et al. | 347/33 |
| 5,182,582 | 1/1993 | Okamura | 347/33 |
| 5,500,660 | 3/1996 | Childers et al. . | |
| 5,585,826 | 12/1996 | Schroeder et al. | 347/33 |
| 5,640,182 | 6/1997 | Behrami et al. | 347/33 |

FOREIGN PATENT DOCUMENTS

| | | |
|---|---|---|
| 446885 A1 | 9/1991 | European Pat. Off. . |
| 362101448 | 5/1987 | Japan . |
| 402179757 | 7/1990 | Japan . |

*Primary Examiner*—Shawn Riley

[57] ABSTRACT

A maintenance station of an ink jet printer includes a blade cleaning station wherein a wiper blade assembly provides independent cleaning of different portions of the front nozzle face of a multi-segment ink jet printhead. In one embodiment, a printer includes a color printhead which contains recording groups of nozzles, each group associated with printing of a different colored ink. Each color group is separated by a non-recording boundary sector. To prevent color mixing during a printhead face wiping operation, a blade assembly is formed with separate blade segments which provide separate wiping actions to each recording segment without mixing adjacent wiped colors. In one embodiment, two blades are staggered in a wipe direction. Each blade has furrows formed along its length to coincide with the non-recording segments of a printhead face. Each blade cleans two non-adjacent recording segments, while the total wiping action is accomplished without mixing of ink into the nozzles of adjacent groups. In another embodiment, a single wiper blade is used with notches formed along its length corresponding to the non-recording printhead segments. A single wiping action is accomplished without excess ink being wiped into the non-recording sections.

8 Claims, 6 Drawing Sheets

WIPER BLADE CLEANING SYSTEM FOR NOZZLE FACES OF A COLOR PRINTHEAD

BACKGROUND AND MATERIAL DISCLOSURE STATEMENT

The present invention relates generally to a system for cleaning the front nozzle face of an ink jet printhead with a wiper blade system and, more particularly, to a system and method for cleaning of the nozzle face of a color printhead having separate recording segments.

An ink jet printer of the so-called "drop-on-demand" type has at least one printhead from which droplets of ink are directed towards a recording medium. Within the printhead, the ink may be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, which are individually addressable by current pulses to heat and momentarily vaporize ink in the channels which contact the resistors. Operation of a thermal ink jet printer is described in, for example, U.S. Pat. No. 4,849,774.

It has been recognized that there is a need to maintain the ink ejecting orifices of an ink jet printer, for example, by periodically cleaning the orifices when the printer is in use, and/or by capping the printhead when the printer is out of use or is idle for extended periods. The capping of the printhead is intended to prevent the ink in the printhead from drying out. There is also a need to prime a printhead before use, to ensure that the printhead channels are completely filled with ink and contain no contaminants or air bubbles Maintenance and/or priming stations for the printheads of various types of ink jet printers are described in, for example, U.S. Pat. Nos. 4,855,764, 4,853,717, 4,746,938 and 5,151,715.

For color ink jet printers, separate printheads are mounted on a print carriage, each printhead supplied by ink of a particular color. The printheads are selectively driven to produce recording swaths of color images forming a full color image.

The colors of the ink used are usually cyan, magenta, yellow and black. The cleaning of the nozzle faces for different colored printheads becomes complicated since, if a single cleaning means, such as a single wiper blade is used to wipe across the front face of the printhead, the wiper blades carries a mixed colored ink residue which may overlap and be transferred back into the nozzles and effect the next droplet ejection from that nozzle. U.S. Pat. 5,182,582 describes one solution to this problem wherein the nozzle faces are cleaned and arranged so that the nozzle faces are cleaned in the order of from lighter to darker inks.

A cleaning problem still exists for multi-color ink jet printheads of the type wherein a single printhead die is segmented into sectors or groups of nozzles, each sector or group being fluidly connected to an ink reservoir for a particular associated ink recording color.

For this configuration, there are boundaries between printhead groups or sectors, and nozzles on both sides of the boundary are susceptible to contamination by ink from the adjoining sector. A simple wiping blade which wipes across the face of the nozzle inevitably causes some transfer and mixing of ink from colored ink nozzles adjacent the boundary sectors into ink of the adjoining color sector. This problem is exacerbated if the nozzle faces are oriented in a vertical plane since the effects of gravity will contribute to contamination of the nozzles immediately below a sector dividing boundary.

SUMMARY OF THE INVENTION

It is an object of the invention to provide a wiper blade system for cleaning the nozzle face of a multi-color segmented printhead.

It is a further object of the invention to use a plurality of wiper blade segments to clean a plurality of recording group nozzle faces with each blade segment wiping only an associated recording group.

In the present invention, and in a first embodiment, a single wiper blade is formed with a plurality of blade sections, one for each nozzle face. In a second embodiment, two wiper blades, each having two blade sections and two non-blade sections, are used to clean the nozzle face of a four segment color printhead. In a third embodiment, a plurality of separate, staggered blades are used to clear a plurality of nozzle face groupings on a color printhead. The wiping efficiency of all of the embodiments is complimented by an ink purging system which minimizes the color mixing at the nozzles.

More particularly, the present invention is directed towards a wiper blade cleaning system for cleaning the nozzle face of an ink jet color printhead having a plurality of color recording segments with at least one non-recording boundary segment separating said recording segments, the system including:

a wiping blade assembly having a plurality of wiping blade segments and wherein, each blade segment positioned so as to independently wipe the nozzle face of an associated color recording segment.

DESCRIPTION OF THE INVENTION

Figure 1:
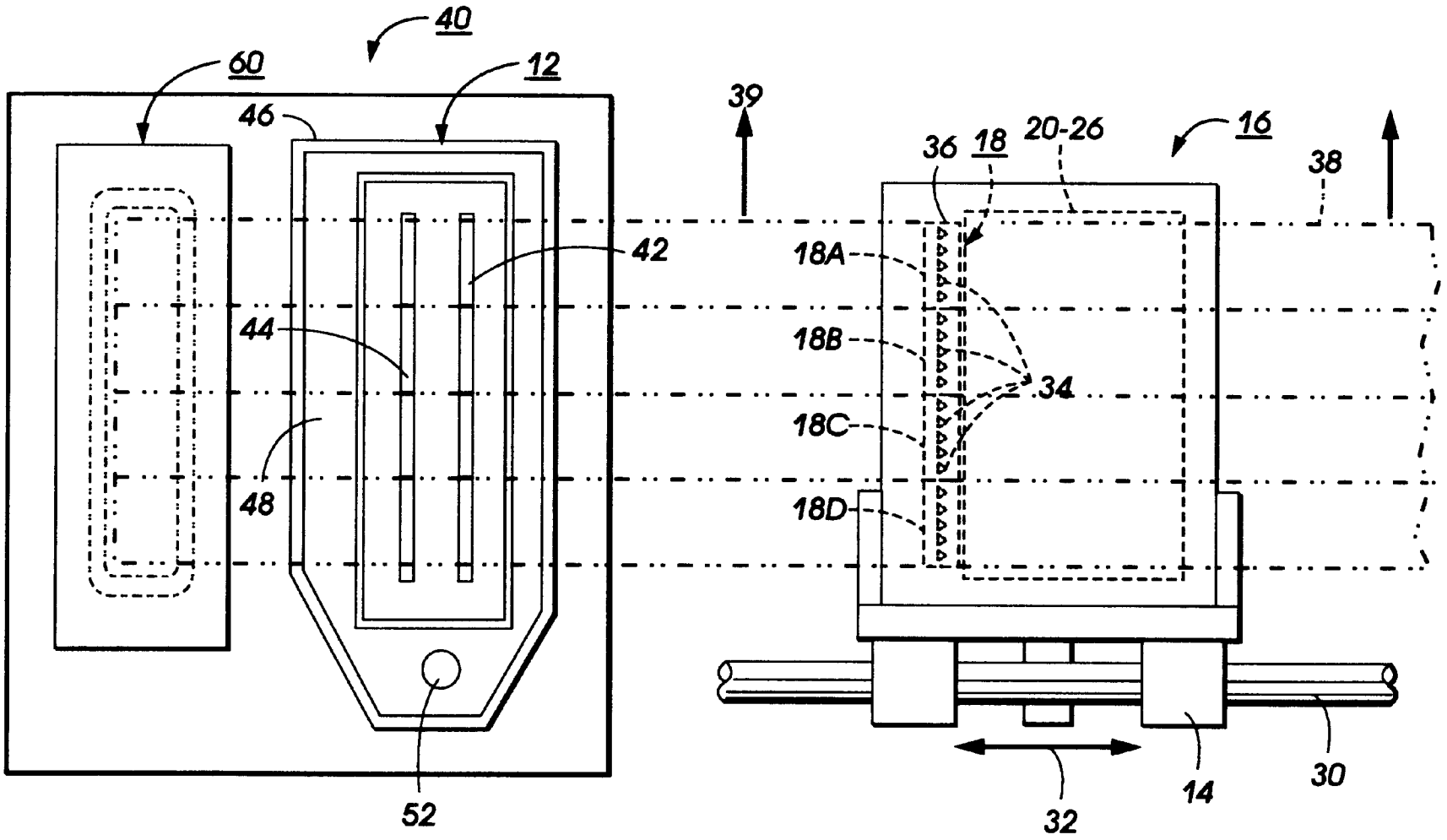
FIG. 1 is a schematic front view of a partially shown ink jet printer having a print station and a maintenance station which incorporates a first embodiment of a multi-color printhead cleaning blade assembly.

FIG. 1 is a schematic perspective view of a color ink jet printer 10 incorporating the wiper blade cleaning assembly 12 of the present invention. In FIG. 1, a carriage 14 carries a color printhead cartridge 16 which includes a printhead 18 having a plurality of (in the illustrated embodiment 4)

recording segments 18A, 18B, 18C, 18D. Each recording segment 18A, 18B, 18C, 18D is fluidly connected to ink containers 20, 22, 24, 26, respectively. Containers 20, 22, 24, 26 contain yellow, cyan, magenta and black inks, respectively. Printhead cartridge 16 forms a unitary recording device comprising the printhead 18 and containers 20–26 and associated printhead drive electronics.

Cartridge 16 is removably mounted on carriage 14 and is translatable back and forth on guide rail 30 as indicated by arrow 32, so that the printhead cartridge moves concurrently with the carriage. Each recording segment 18A–18D contains a plurality of ink channels (not shown) which terminate in nozzles 34 in nozzle face 36 (both shown in dashed line in FIG. 1) and carry ink from the associated ink container to the respective ink ejecting nozzles 34 of the particular recording segments. When the printer is in the printing mode, the carriage translates or reciprocates back and forth across and parallel to a printing zone 38 (shown in dashed line) and ink droplets (not shown) are selectively ejected on demand from the printhead recording segments 18A–18D nozzles onto a recording medium (not shown), such as paper, in the printing zone, to print information thereon one swath at a time. During each pass or translation in one direction of the carriage 14, the recording medium is stationary, but at the end of each pass, the recording medium is stepped in the direction of arrow 39 for the distance of the height of one printed swath. Recording segments 18A–18D are formed by known techniques such as those disclosed, for example, in U.S. Pat. No. 4,571,599 and Re. 32,572, incorporated herein by reference. Carriage drive details are also disclosed in these references.

At one side of the printer, outside the printing zone, is a maintenance station 40. At the end of a printing operation or termination of the printing mode by the printer 10, the carriage 14 is first moved past the wiper blade cleaning assembly 12 of the present invention comprising, in a first embodiment, two releasably mounted wiper blades 42,44 in blade holder 46, so that the printhead nozzle face 36 is wiped free of ink and debris each time the printhead cartridge 16 enters or exits the maintenance station. Adjacent the movable wiper blade holder, in the direction away from the printing zone and at a predetermined location along the translating path of the print cartridge, is a collection surface 48. The carriage will position the print cartridge at this collection surface, sometimes referred to as a spit station or spittoon, after the print cartridge has been away from the maintenance station for a specific length of time, even if continually printing, because not all nozzles will have ejected enough ink droplets to prevent the ink or meniscus in the little used nozzles from drying and becoming too viscous. Accordingly, the print cartridge will be moved by, for example, a carriage motor (not shown) under the control of the printer controller (not shown) past the wiper blade assembly 12, cleaning the nozzle face in a manner described in further detail below, and to the predetermined location confronting the collection surface 48, whereat the printer controller causes each recording segment 18A–18D to eject a number of ink droplets per nozzle therein. Ink deposited on the collection surface, which is substantially parallel to the printhead nozzle face and vertically oriented, is caused to move under the force of gravity towards the lower portion thereof, where an opening 52 is located for the ink to drain therethrough into a pad of absorbent material (not shown) behind the collection surface 48.

Optionally, when the carriage 14 continues to be moved along guide rail 30 beyond the structural member 50 for a predetermined distance to enter a capping/priming station 60, conventionally, the printhead nozzle face 36 is capped and the cap is locked to the print cartridge. The printer controller may optionally cause the printhead to eject a predetermined number of ink droplets for the purpose of increasing humidity in the sealed space of the cap recess and may also carry through a priming operation. Details of operation of a capping station are disclosed in U.S. Pat. No. 5,396,271, whose contents are hereby incorporated by reference.

Figure 2:
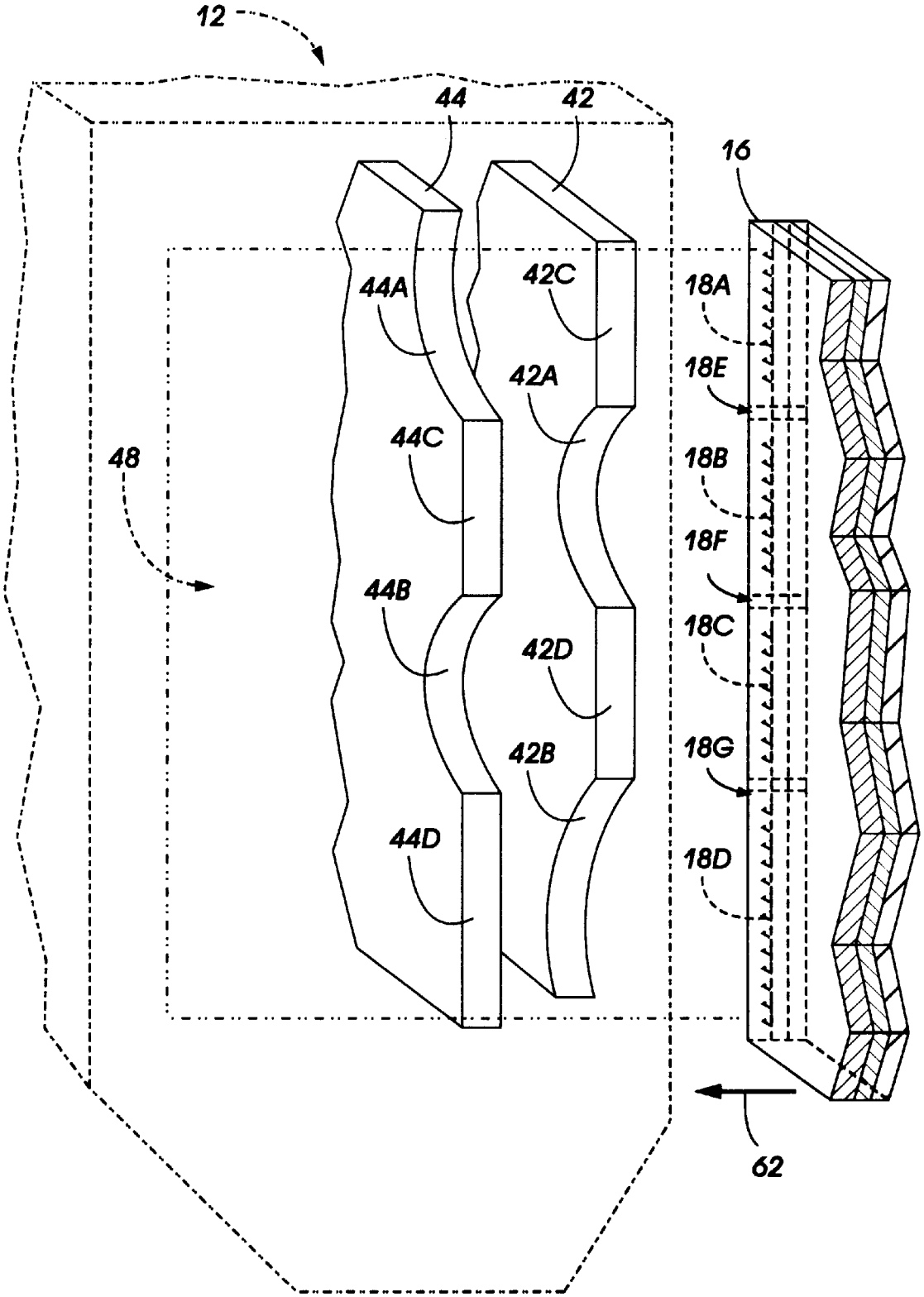
FIG. 2 is a perspective view of the cleaning blade assembly of FIG. 1 showing the color printhead approaching the assembly in a wipe direction.

Turning now to FIG. 2 which shows a first embodiment of the invention, a portion of wiping station 12 including blades 42, 44 and collection surface 48 is shown. The nozzle face 36 of printhead 18 is shown moving from the capping station in a wipe direction indicated by arrow 62. The construction of the printhead 18 is shown in further detail to include non-recording sections 18E, 18F and 18G positioned between recording segments 18A, 18B; 18B, 18C and 18C, 18D, respectively. These non-recording sections are very small (2.3 mm) and may, in fact, comprise one or two dummy (non-functioning) nozzles. The spacing must be kept as small as possible to maintain consistent ink reproduction at recording swath boundaries. The purpose of the segments is to prevent an overlap of ink droplets ejected from adjacent segments. For example, section 18E provides a buffer between lower nozzles of yellow ink segment 18A and the upper nozzles of magenta ink segment 18B. However, following a print cycle there may be some ink flow downward into the nozzles of adjacent ink recording segments creating a potential for mixing the output inks with another recording ink. Simply wiping the nozzle face 36 with a unitary wiping blade would tend to smear and mix the ink. Accordingly, wiper blades 42 and 44 are formed with semi-circular furrows 42A, 42B and 44A, 44B, respectively. The furrows are formed by removing a portion of the otherwise unitary blade surface leaving two active wiping segments on each blade. The furrows are deep enough to prevent ink migration from one zone to another. Thus, blade 42 has active wiping segments 42C, 42D, while blade 44 has active wiping segments 44C, 44D. When printhead cartridge 16 is moved in the wipe direction, blade 42 provides a first wiping action. Blade segment 42C has a vertical length to provide a wiping zone configured to wipe the nozzles in yellow recording segment 18A; blade segment 42D wipes the nozzles in cyan recording segment 18C and part of boundary segment 18D. Wiper blade segment 44C wipes the magenta recording segment 18B and boundary segment 18E while wiper segment 44D wipes black recording segment 18D. The ink wiped from the front face collects onto surface 48. After a wipe operation, as the printhead continues to advance in the wipe direction, an ink purge operation is initiated to eject a predetermined number of drops. The number of purge drops/nozzle would be greater for the nozzles at the color boundaries to further eliminate effects of ink mixing.

It is apparent that the sequential and combined wiping action of blades 42, 44 serves to sequentially wipe non-adjacent recording segments with a cumulative result of wiping the entire nozzle face without causing mixture of inks due to the wiping operation.

Figure 3:
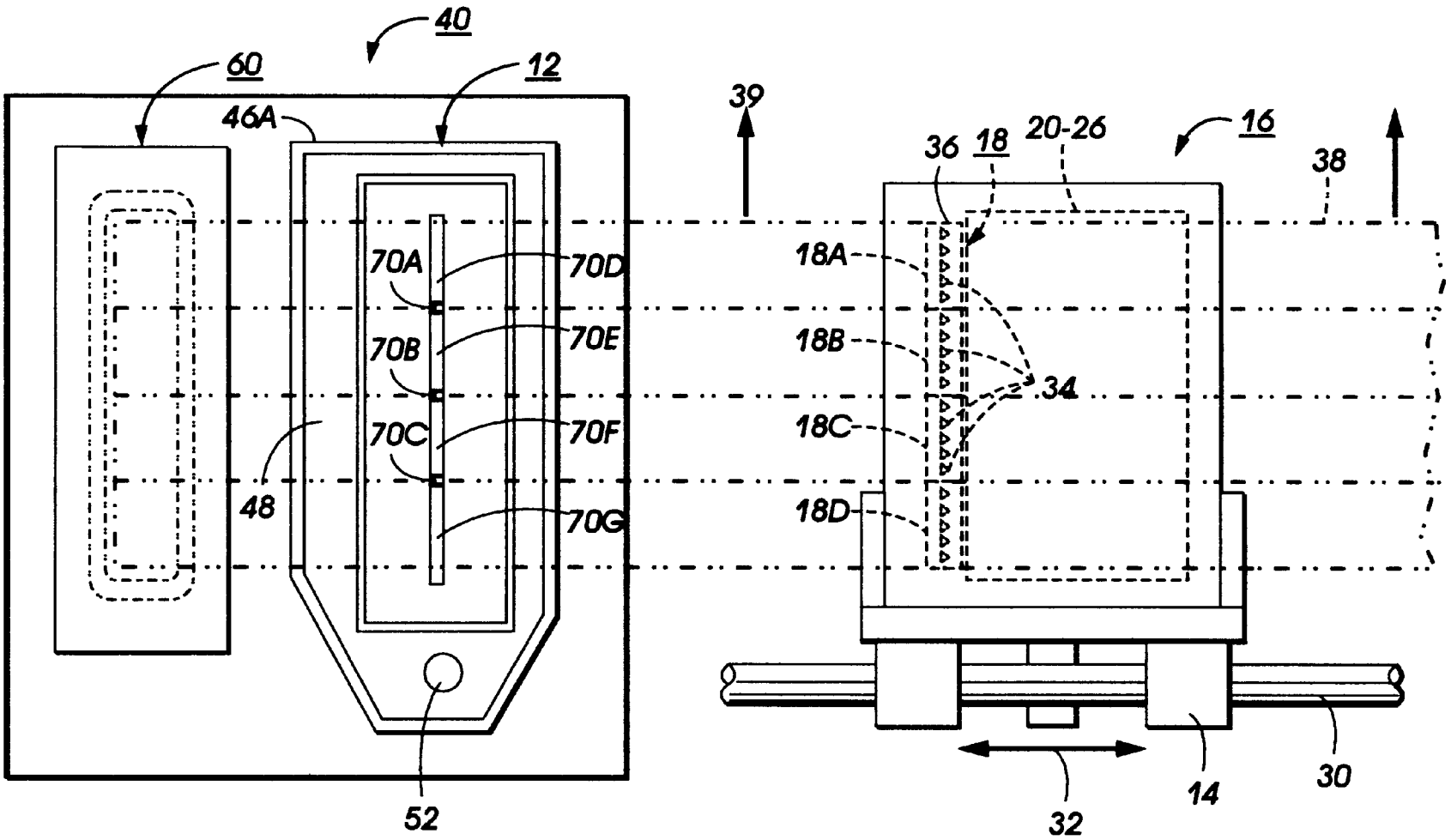
FIG. 3 is a front view of the print and maintenance stations, the latter incorporating a second embodiment of a multi-color printhead cleaning blade assembly according to the present invention.
Figure 4:
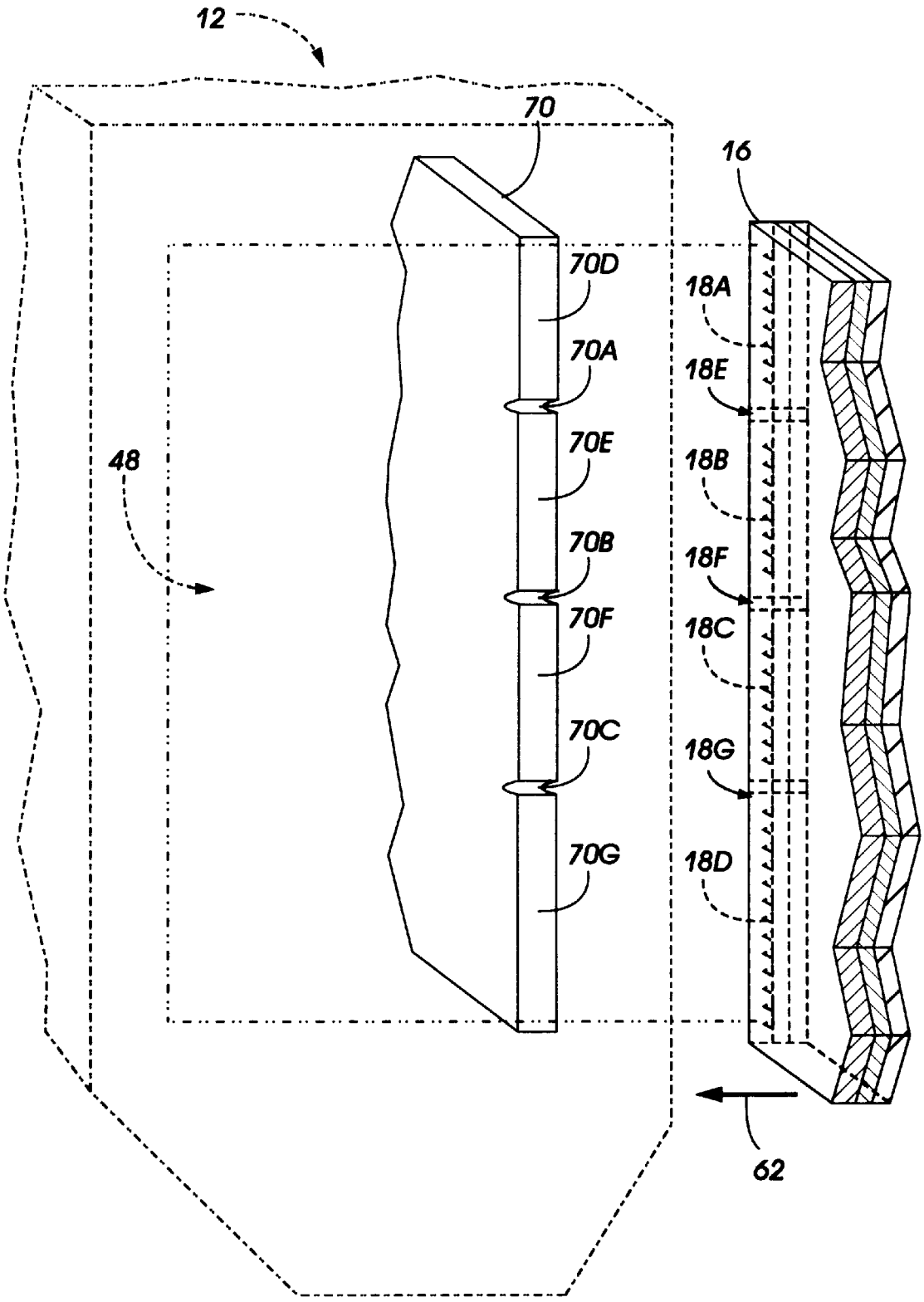
FIG. 4 is a perspective view of the cleaning blade assembly of FIG. 3 showing the printhead approaching the assembly in a wipe direction.

FIGS. 3 and 4 show a second embodiment of the invention wherein wiping station 12 includes a single wiper blade 70 supported in a modified blade holder 46A. Blade 70 is formed with notches 70A, 70B, 70C at positions corresponding to non-recording segments 18E, 18F, 18G of printhead 18 respectively. For this embodiment, the active wipe segments are shown as 70D, 70E, 70F, 70G. As printhead face 36 moves in a wipe direction past blade 70, recording segments 18A–18D are simultaneously wiped by blade segments 70D–70G, respectively. The interposition of notches 70A–70C prevents ink from being wiped from nozzles of adjacent groups.

Figure 5:
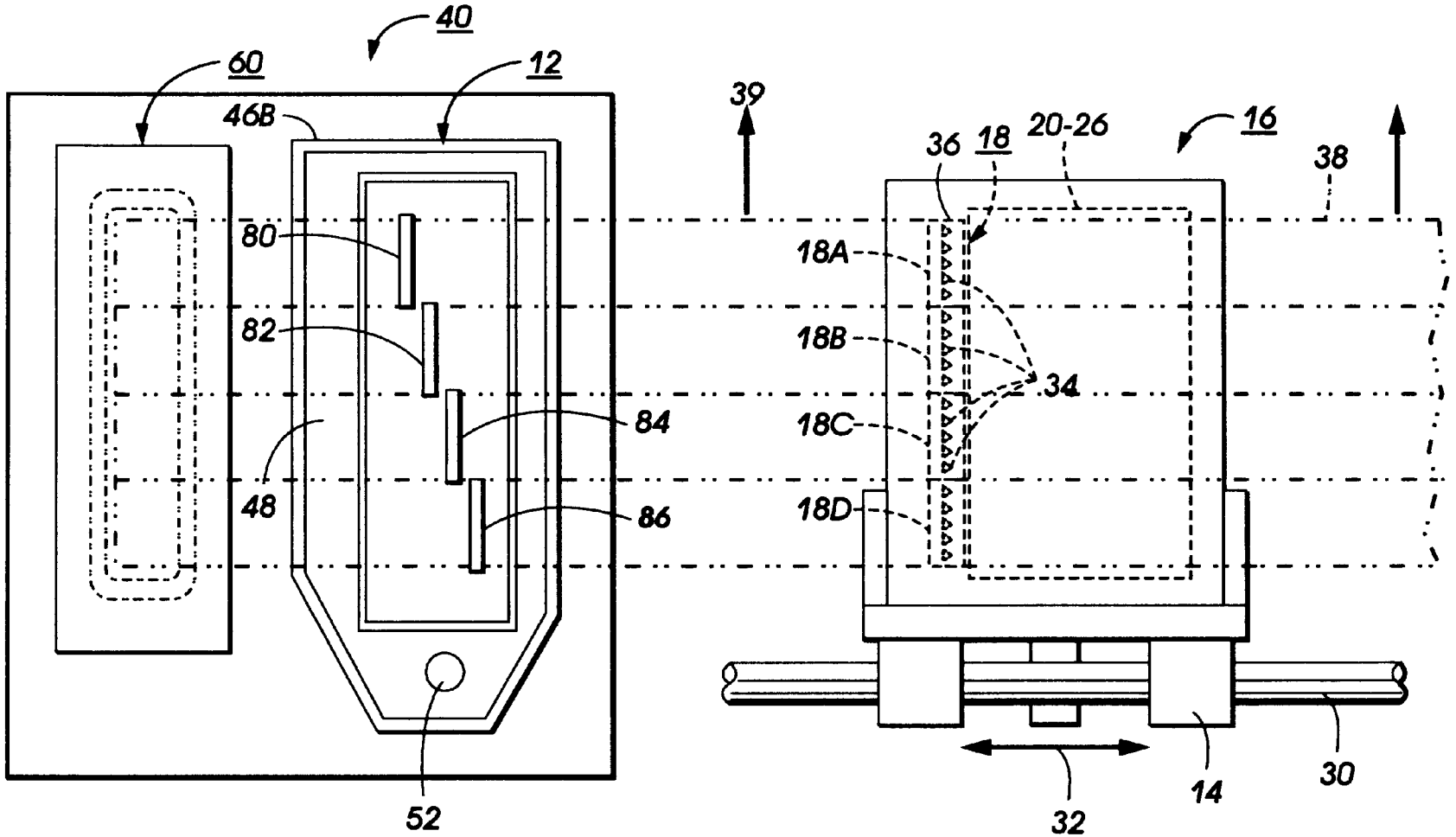
FIG. 5 is a front view of the print and maintenance stations, the latter incorporating a third embodiment of a multi-color printhead cleaning assembly according to the present invention.
Figure 6:
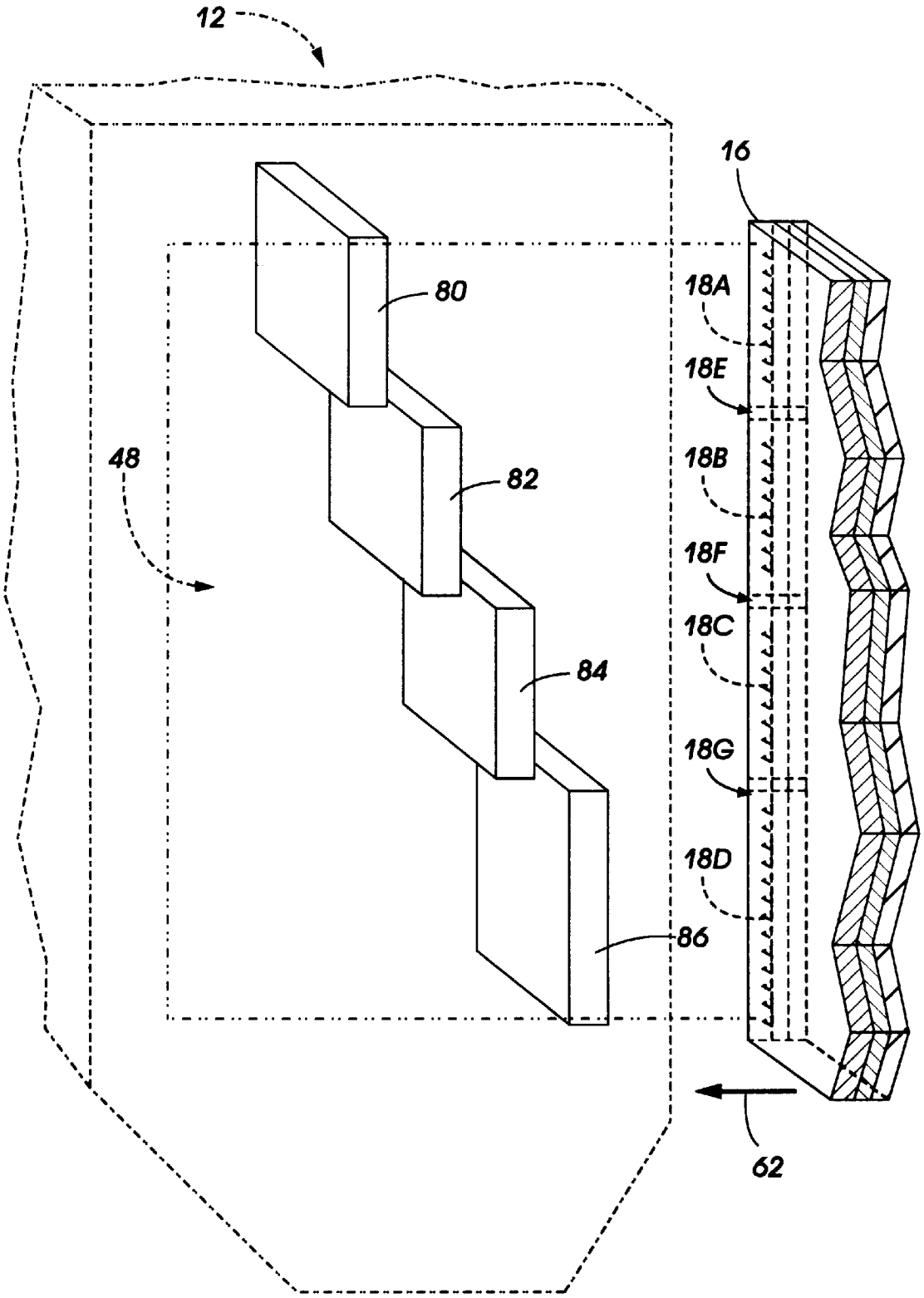
FIG. 6 is a perspective view of the cleaning blade assembly of FIG. 3 showing the printhead approaching the assembly in a wipe direction.

FIGS. 5 and 6 show a third embodiment of the invention wherein wiping station 12 includes four wiping blade segments, 80, 82, 84, 86, each blade separated by a distance equal to spaces 18E, 18F, 18G. Each blade is supplied in a modified blade holder 46B. The vertical face of blades 80–86 are configured to wipe the nozzles comprising segments 18A–18D, respectively. As in the other embodiments, any excess wiped off collects in spittoon 50 while ink is not wiped across the boundary segments.

While the printer 10 shown in FIG. 1 included a printhead with four recording segments, the invention can be used on unitary printheads having two or more recording segments with at least one boundary between segments recording different colors. Thus, for example, for a two color printhead with two recording segments, the embodiment of FIGS. 3 and 4 would be formed with one notch between two wiping segments, while the embodiment of FIGS. 5 and 6 would include two wiping blades.

While the embodiment disclosed herein is preferred it will be appreciated from this teaching that various alternative modifications, variations or improvements therein may be made by those skilled in the art which are intended to be encompassed by the following claims:

I claim:

1. A wiper blade cleaning system for cleaning a nozzle face of an ink jet color printhead having a plurality of color recording segments, each segment being fluidly connected to an ink reservoir holding ink of a specified color the wiper blade cleaning system further including:

a wiping blade assembly having a plurality of wiping blade segments and wherein, each wiping blade segment is positioned so as to independently wipe a nozzle face of an associated color recording segment of said color printhead.

2. The system of claim 1 further including at least one non-recording boundary segment separating said color recording segments and wherein said wiping blade assembly is a unitary blade member having notches along a wiping length at locations corresponding to said non-recording boundary segments whereby the plurality of wiping segments are separated by said notches.

3. The system of claim 1 wherein said wiping blade assembly comprises a plurality of wiping blades staggered along a wipe direction, each wiping blade having a wiping length corresponding to an associated color recording segment.

4. The system of claim 1 wherein said color printhead has four color recording segments separated by three non-recording boundary segments.

5. The system of claim 4 wherein said wiping blade assembly comprises two wiping blades staggered along a wipe direction, each wiping blade having a pair of wiping segments and a pair of furrows, each wiping segment positioned so as to perform a wiping action on an associated recording segment, while the furrows are positioned in line with said non-recording boundary segments.

6. The system of claim 4 wherein said wiping blade assembly comprises a single flexible wiping blade having three notches formed along a length, the notches corresponding to said non-recording boundary segments, non-notched areas comprising wiper blade segments for wiping nozzle faces of corresponding recording segments.

7. The system of claim 4 wherein said wiping blade assembly comprises four wiping blades staggered along a wipe direction, each wiping blade positioned so as to wipe a nozzle face of an associated color recording segment.

8. A wiper blade cleaning assembly located in an ink jet printer maintenance station for wiping a nozzle face of an ink jet printhead, said printhead having a plurality of multiple recording segments arranged along a length, the assembly comprising:

means for moving said printhead into said maintenance station and a plurality of wiper blade segments arranged along a path of travel of said printhead, each segment providing separate and independent wiping of each said recording segment as said printhead is moved therepast.

* * * * *